US007118698B2

(12) United States Patent
Armantrout et al.

(10) Patent No.: US 7,118,698 B2
(45) Date of Patent: Oct. 10, 2006

(54) ROTARY PROCESS FOR FORMING UNIFORM MATERIAL

(75) Inventors: Jack Eugene Armantrout, Richmond, VA (US); Lewis Edward Manring, West Chester, PA (US); Robert Anthony Marin, Midlothian, VA (US); Larry R. Marshall, Chesterfield, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 193 days.

(21) Appl. No.: 10/818,152

(22) Filed: Apr. 5, 2004

(65) Prior Publication Data

US 2004/0219345 A1 Nov. 4, 2004

Related U.S. Application Data

(60) Provisional application No. 60/460,185, filed on Apr. 3, 2003.

(51) Int. Cl.
*D01D 5/11* (2006.01)
*D01D 5/18* (2006.01)

(52) U.S. Cl. ..... 264/205; 264/211.1

(58) Field of Classification Search ..... 264/13, 264/14, 205, 211.1, 465
See application file for complete search history.

(56) References Cited

U.S. PATENT DOCUMENTS

| | | | |
|---|---|---|---|
| 2,587,710 | A | 3/1952 | Downey |
| 3,081,519 | A | 3/1963 | Blades et al. |
| 3,097,085 | A | 7/1963 | Wallsten |
| 3,169,899 | A | 2/1965 | Steuber |
| 3,227,784 | A | 1/1966 | Blades et al. |
| 3,388,194 | A | 6/1968 | Vinicki |
| 3,654,074 | A | 4/1972 | Jacquelin |
| 3,776,669 | A | 12/1973 | Ito et al. |
| 3,851,023 | A | 11/1974 | Brethauer et al. |
| 3,882,211 | A | 5/1975 | Kamp |
| 3,914,080 | A | 10/1975 | Kamp |
| 3,920,362 | A | 11/1975 | Bradt |
| 3,978,976 | A | 9/1976 | Kamp |
| 4,440,700 | A | 4/1984 | Okada et al. |
| 4,790,736 | A | 12/1988 | Keuchel |
| 4,898,636 | A | 2/1990 | Rigling |
| 4,937,020 | A | 6/1990 | Wagner et al. |
| 5,073,436 | A | 12/1991 | Antonacci et al. |
| 5,114,787 | A | 5/1992 | Chaplin et al. |
| 5,173,356 | A | 12/1992 | Eaton et al. |
| 5,182,162 | A | 1/1993 | Andrusko |
| 5,187,005 | A | 2/1993 | Stahle et al. |
| 5,208,089 | A | 5/1993 | Norris |
| 5,244,724 | A | 9/1993 | Antonacci et al. |
| 5,252,158 | A | 10/1993 | Shimizu et al. |
| 5,436,074 | A | 7/1995 | Shimura et al. |
| 5,788,993 | A | 8/1998 | Bryner et al. |
| 5,795,651 | A | 8/1998 | Matsuoka et al. |
| 5,888,916 | A | 3/1999 | Tadokoro et al. |
| 2002/0090876 | A1 | 7/2002 | Takase et al. |

FOREIGN PATENT DOCUMENTS

| | | |
|---|---|---|
| WO | WO 92/20511 A1 | 11/1992 |
| WO | WO 98/39509 A1 | 9/1998 |

*Primary Examiner*—Leo B. Tentoni

(57) ABSTRACT

A process is provided for issuing material from a nozzle in a rotor rotating at a given rotational speed wherein the material is issued by way of a fluid jet. The material can be collected on a collector concentric to the rotor. The collector can be a flexible belt moving in the axial direction of the rotor. The collected material can take the form of discrete particles, fibers, plexifilamentary web, discrete fibrils or a membrane.

41 Claims, 3 Drawing Sheets

ROTARY PROCESS FOR FORMING UNIFORM MATERIAL

FIELD OF THE INVENTION

The present invention relates to the field of issuing material from a rotating rotor and collecting a portion of the material in the form of fibrous nonwoven sheet, discrete fibrils, discrete particles or polymeric beads.

BACKGROUND OF THE INVENTION

Manufacturing processes in which a material is formed by propelling a fluidized mixture from a nozzle by way of a fluid jet upon which the material solidifies into a desired form are known in the art. For example, spray nozzles are used for spraying liquid paints which can contain pigments, binders, paint additives and solvents, the solvents of which flash or vaporize after the paint is applied to a surface leaving dry paint. Processes for producing fine particles are known in which a mist of a solution is propelled from an atomizing nozzle upon which the solvent flashes or vaporizes leaving the dry particles. While these processes are capable of forming fine, uniform particles, there is no existing process for collecting the particles in a manner that preserves the uniformity of the newly issued particles, owing to the extremely high speed at which they are propelled.

Flash spinning is an example of a spray process having very high issuance speed. Flash spinning processes involve passing a fiber-forming substance in solution with a volatile fluid, referred to herein as a "spin agent," from a high temperature, high pressure environment into a lower temperature, lower pressure environment, causing the spin agent to be flashed or vaporized, and producing materials such as fibers, fibrils, foams or plexifilamentary film-fibril strands or webs. The temperature at which the material is spun is above the atmospheric boiling point of the spin agent so that the spin agent vaporizes upon issuing from the nozzle, causing the polymer to solidify into fibers, foams or film-fibril strands. Conventional flash spinning processes for forming web layers of plexifilamentary film-fibril strand material are disclosed in U.S. Pat. No. 3,081,519 (Blades et al.), U.S. Pat. No. 3,169,899 (Steuber), and U.S. Pat. No. 3,227,784 (Blades et al.), U.S. Pat. No. 3,851,023 (Brethauer et al.). However, the web layers formed by these conventional flash spinning processes are not entirely uniform.

SUMMARY OF THE INVENTION

The present invention relates to a process comprising the steps of supplying a fluidized mixture having at least two components at a pressure greater than atmospheric pressure to a rotor spinning about an axis at a rotational speed, the rotor having at least one material-issuing nozzle comprising an opening therein along the periphery of the rotor; issuing the fluidized mixture from the opening of the nozzle at a reduced pressure relative to that in the supplying step to form an issued material at a material issuance speed; vaporizing or expanding at least one component of the issued material to form a fluid jet; and transporting the remaining component(s) of the issued material away from the rotor by the fluid jet; and optionally collecting the remaining component(s) of the issued material on a collection surface of a collection belt concentric to the axis of the rotor to form a collected material, the collection belt moving in a direction parallel to the axis of the rotor at a collection belt speed. In another embodiment, the present invention relates to an apparatus for rotational spinning comprising a rotor body; at least one nozzle within the rotor body having an inlet for receiving a fluidized mixture at above ambient temperature and pressure, and an outlet in fluid communication with the inlet, the outlet opening to the outer periphery of the rotor, wherein the nozzle further comprises a letdown chamber for holding the fluidized mixture at a pressure lower than its cloud point; a letdown orifice intermediate the inlet and the letdown chamber; and a spin orifice intermediate the letdown chamber and the outlet.

In another embodiment, the present invention relates to a fibrous nonwoven sheet having a machine direction uniformity index of less than about 82 $(g/m^2)^{1/2}$, an elongation to break of greater than about 15%, and a ratio of tensile strength to basis weight of greater than about 0.78 N/cm/g/$m^2$.

DEFINITIONS

The terms "jet" and "fluid jet" are used herein interchangeably to refer to an aerodynamic moving stream of fluid including gas, air or steam. The terms "carrying jet" and "material-carrying jet" are used herein interchangeably to refer to a fluid jet transporting material in its flow.

The terms "nonwoven fabric," "nonwoven sheet," "nonwoven layer," or "web" as used herein can be used interchangeably to refer to a structure of individual fibers or filaments that are arranged to form a planar material by means other than knitting or weaving.

The term "machine direction" (MD) is used herein to refer to the direction of movement of a moving collection surface. The "cross direction" (CD) is the direction perpendicular to the machine direction.

The term "polymer" as used herein, generally includes but is not limited to, homopolymers, copolymers (such as for example, block, graft, random and alternating copolymers), terpolymers, etc., and blends and modifications thereof. Furthermore, unless otherwise specifically limited, the term "polymer" shall include all possible geometric configurations of the molecules, including but not limited to isotactic, syndiotactic and random symmetries.

The term "polyolefin" as used herein, is intended to mean any of a series of largely saturated polymeric hydrocarbons composed only of carbon and hydrogen. Typical polyolefins include, but are not limited to, polyethylene, polypropylene, polymethylpentene and various combinations of the monomers ethylene, propylene, and methylpentene.

The term "polyethylene" as used herein is intended to encompass not only homopolymers of ethylene, but also copolymers wherein at least 85% of the recurring units are ethylene units such as copolymers of ethylene and alpha-olefins. Preferred polyethylenes include low density polyethylene, linear low density polyethylene, and linear high density polyethylene. A preferred linear high density polyethylene has an upper limit melting range of about 130° C. to 140° C., a density in the range of about 0.941 to 0.980 gram per cubic centimeter, and a melt index (as defined by ASTM D-1238-57T Condition E) of between 0.1 and 100, and preferably less than 4.

The term "polypropylene" as used herein is intended to embrace not only homopolymers of propylene but also copolymers where at least 85% of the recurring units are propylene units. Preferred polypropylene polymers include isotactic polypropylene and syndiotactic polypropylene.

The terms "plexifilament", "plexifilamentary film-fibril strand material", "plexifilamentary web", "flash spun web", and "flash spun sheet" are used herein interchangeably to refer to a plexifilamentary film-fibril web material having a three-dimensional integral network or web of a multitude of thin, ribbon-like, film-fibril elements of random length and with a mean film thickness of less than about 4 micrometers and a median fibril width of less than about 25 micrometers. In plexifilamentary structures, the film-fibril elements intermittently unite and separate at irregular intervals in various places throughout the length, width and thickness of the structure to form a continuous three-dimensional network.

The term "spin agent" is used herein to refer to a volatile fluid in a polymeric solution capable of being flash spun, according to the processes disclosed in U.S. Pat. No. 3,081,519 (Blades et al.), U.S. Pat. No. 3,169,899 (Steuber), and U.S. Pat. No. 3,227,784 (Blades et al.), U.S. Pat. No. 3,851,023 (Brethauer et al.).

BRIEF DESCRIPTION OF THE DRAWINGS

The accompanying drawings, which are incorporated in and constitute a part of this specification, illustrate the presently preferred embodiments of the invention and, together with the description, serve to explain the principles of the invention.

DETAILED DESCRIPTION OF THE INVENTION

Figure 1:
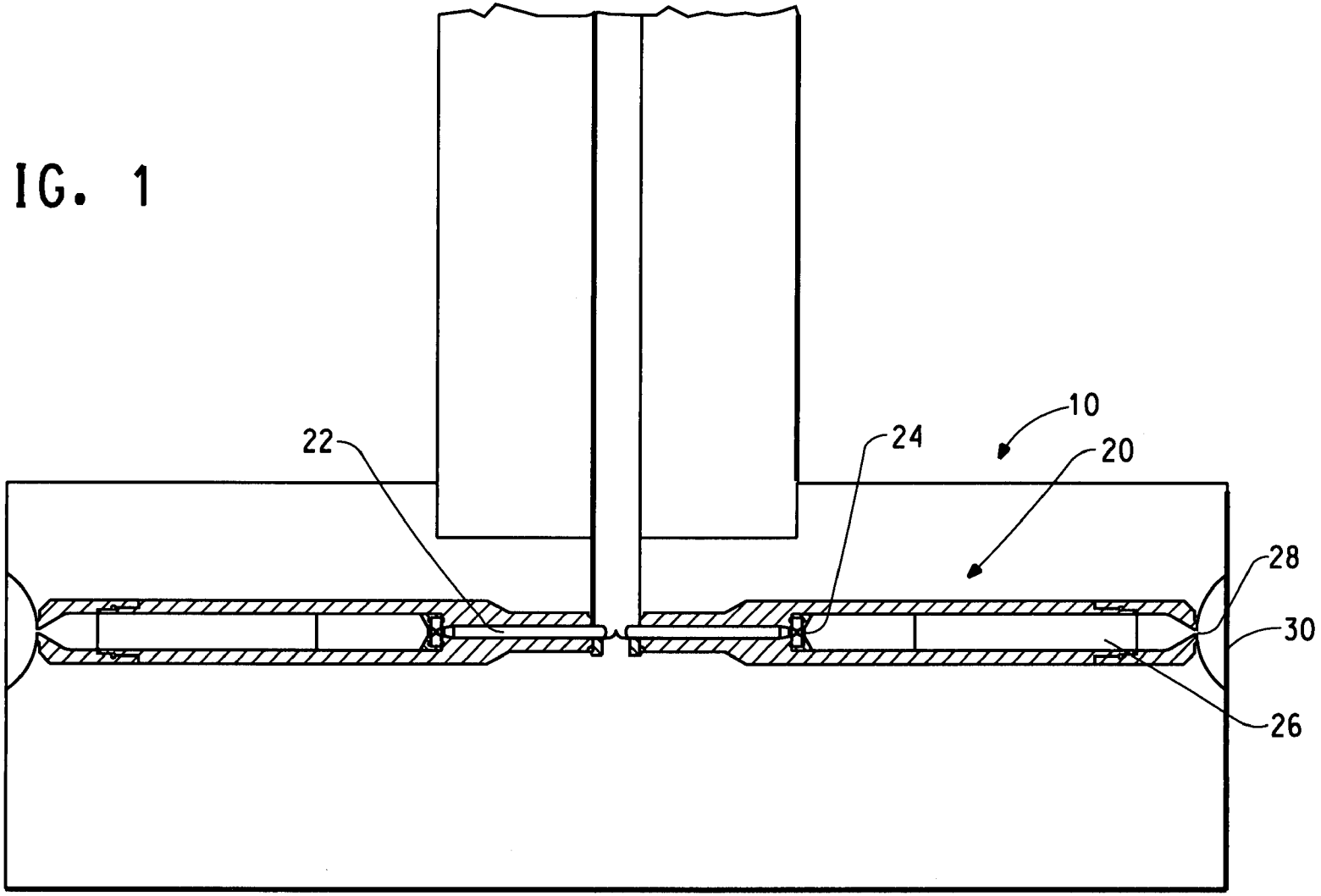
FIG. 1 is a cross-section of a rotor used in the process of the invention.

Reference will now be made in detail to the presently preferred embodiments of the invention, examples of which are illustrated in the accompanying drawings. Throughout the drawings, like reference characters are used to designate like elements.

One difficulty with conventional flash spinning processes is in attempting to collect the web layers in a perfectly spread state and at the speed at which they are moving, which might result in a product with excellent uniformity of thickness and basis weight. In conventional processes, the speed at which the solution is propelled from the nozzles, which is also the speed at which the web layers are formed, is on the order of 300 kilometers per hour, depending on the molecular weight of the spin agent, while the web layers are typically collected on a belt moving at a speed of 8–22 kilometers per hour. Some of the slack introduced into the process by the difference between the web formation speed and the web take-up speed is taken up by oscillating the web layers in the cross-machine direction; however, this does not result in uniformly spread web layers.

It would be desirable to have a process that would result in a more uniform deposition of sprayed particulates, in particular a plexifilamentary film-fibril sheet having improved uniformity of web distribution and of basis weight.

The present inventors have developed a process in which the speed of collection of discrete particles issued or "spun" from a nozzle by way of a fluid jet more closely matches the speed at which the particles are issued, as well as a process for forming material in the form of a web, a fibrous sheet material, a membrane, or discrete fibrils, by issuing a fluidized mixture from a rotating nozzle by way of a fluid jet and collecting it at a speed which approximates the speed at which it is issued.

In the process of the present invention, a fluidized mixture comprising at least two components is supplied to a nozzle located in a rotor rotating about an axis. The fluidized mixture is supplied to the nozzle at a pressure greater than atmospheric pressure. The fluidized mixture is issued or "spun" at high speed from an opening in the nozzle to form an issued material. The exact form of the nozzle will depend on the type of material being issued and the desired product. The nozzle has an inlet end for receiving the fluidized mixture and an outlet end opening to the outer periphery of the rotor for issuing the mixture as the issued material. Upon issuing from the outlet end of the nozzle into the lower pressure environment surrounding the rotor, one of the components of the issued material is immediately either converted to vapor phase or rapidly expanded if already in vapor phase and the remaining component(s) of the issued material are solidified and propelled from the nozzle. Preferably, at least one-half of the mass of the fluidized mixture is vaporized, or expanded as a vapor upon issuing from the nozzle.

The remaining component(s) of the issued material, that is the solidified material which does not vaporize immediately upon being issued, also referred to herein as the "solidified material," can take the form of web, discrete particles, foam made up of hollow discrete particles, discrete fibrils, polymeric beads or plexifilamentary film-fibril strands. The discrete particles can be made to coalesce upon being collected on a collection surface or during subsequent processing, to form a porous or non-porous membrane. The solidified material is transported away from the rotor by a high speed fluid jet that originates in the rotor, formed by the rapid flashing or expanding of the vaporizing component of the fluidized mixture. The fluid jet can comprise steam, air or other gas, including flashing spin agent. The speed of the fluid jet carrying the solidified material as it issues from the rotor is at least about 100 feet per second (30 m/s), preferably greater than about 200 feet per second (61 m/s). The solidified material is collected by a means appropriate for the form of the material and the desired product. When a sheet material is desired, a collector is used that is a concentric collection surface spaced a certain distance from the rotor. Advantageously, the collection surface can be located a distance from about twice the thickness of the collected material on the collection surface to about 15 cm from the nozzle. Advantageously, the collection surface is located a distance of about 0.5 cm to about 8 cm from the nozzle. The collection surface can be a moving belt, or a collection surface conveyed by a moving belt. The collector can be a moving collection belt, a stationary cylindrical structure, a collecting substrate being conveyed by a moving belt or a collection container, as appropriate for the particular material being collected. When the issued material is collected on a collection belt, the solidified component(s) of the issued material separate from the fluid jet, or the vaporizing component of the issued material, and remain on the collection surface of the collection belt.

In one embodiment of the present invention, the material is flash spun through the nozzle to form a plexifilamentary film-fibril web, discrete fibrils or discrete particles. The conditions required for flash spinning are known from U.S. Pat. No. 3,081,519 (Blades et al.), U.S. Pat. No. 3,169,899 (Steuber), U.S. Pat. No. 3,227,784 (Blades et al.), U.S. Pat. No. 3,851,023 (Brethauer et al.), the contents of which are hereby incorporated by reference.

A fluidized mixture comprising a polymeric solution of a polymer and a spin agent is supplied to the inlet of the nozzle at a temperature greater than the boiling point of the spin agent and at a pressure sufficient to keep the mixture in the liquid state. FIG. 1 is a cross-sectional view of a rotor 10 for use in the process of the present invention that includes a nozzle 20. The nozzle includes a passage 22 through which the polymeric solution is supplied to a letdown orifice 24. The letdown orifice 24 opens into a letdown chamber 26 for holding the polymer solution at a letdown pressure lower than its cloud point to enter a region of two phase separation of polymer and spin agent. The letdown chamber leads to a spin orifice 28 that opens to the outlet or opening of the nozzle. The polymer-spin agent mixture is issued from the nozzle, preferably at a temperature above the boiling temperature of the spin agent. The environment into which the mixture is issued is advantageously within about 40° C. of the boiling temperature of the spin agent, or even within about 10° C. of the boiling temperature of the spin agent, and at a pressure that is reduced relative to the supply pressure at the nozzle inlet.

Material is issued from the nozzle(s) 20 assisted by a fluid jet, also referred to herein as a "carrying jet," which begins expanding within the nozzle and continues expanding upon issuing from the nozzle, and which carries and propels the issued material at high speed away from the outlet of the nozzle. The jet begins as laminar flow and decays into turbulent flow at some distance from the outlet of the nozzle. When a fibrous web is flash spun from the nozzle and carried by the carrying jet, the form of the web itself will be determined by the type of fluid flow of the jet. If the jet is in laminar flow, the web will be much more evenly spread and distributed than if the jet is in turbulent flow, thus it is desirable to collect the flash spun web prior to the onset of turbulent flow.

The issuance speed of the material can be controlled by varying the pressure and temperature at which the material is issued by the jet and the design of the opening through which it is issued.

In flash spinning, the issuance speed at which the material is propelled by the jet varies depending on the spin agent used in the polymeric solution. It has been observed that the higher the molecular weight of the spin agent, the lower the issuance speed of the jet. For example, using trichlorofluoromethane as the spin agent in the polymeric solution has been found to result in a jet issuance speed of about 150 m/s, while using pentane which has a lower molecular weight as the spin agent has been found to result in a jet issuance speed of about 200 m/s. The speed of the issuing material in the radial direction away from the rotor is determined primarily by the jet issuance speed and not by the centrifugal force caused by the rotation of the rotor.

Referring to FIG. 1, the outlet end of the nozzle 20 can optionally comprise a slotted outlet, also referred to herein as a "fan jet," as described in U.S. Pat. No. 5,788,993 (Bryner et al.), the contents of which are hereby incorporated by reference. The fan jet is defined by two opposing faces 30 immediately downstream of the spin orifice 28. The use of such a fan jet causes the material-carrying jet being issued through the spin orifice to spread across the width of the slot. The fluid jet spreads the material in different directions as determined by the orientation of the slot. According to one embodiment of the present invention, the slot is oriented primarily in the axial direction, causing the material to be spread in the axial direction. This results in an even distribution of material as it is issued. By "primarily in the axial direction" is meant that the long axis of the slot is within about 45 degrees of the axis of the rotor. If desired, the slotted outlet of the nozzle 20 can alternatively be oriented in a generally non-axial direction. By "non-axial direction" is meant that the long axis of the slot is at a greater than about 45-degree angle from the axis of the rotor.

The nozzle outlet can be directed in a primarily radial or non-radial direction. When the nozzle outlet is directed in the radial direction, the carrying jet is able to transport the issued material farther from the rotor than when the nozzle is directed non-radially. This becomes important when a collector is located a certain distance or gap from the rotor concentric to the rotor and the material must traverse the gap in order to be collected. The nozzle outlet also can be oriented such that it is directed non-radially, in a direction away from the direction of rotation. When this is the case and the issued material is being collected on a concentric collector, the gap between the rotor and the collector should be minimized in order to avoid wrapping of the material around the rotor. In this case, the issuance speed of the jet should approximate the tangential speed at the periphery of the rotor and the gap should be minimized as much as is practical. The advantage of this embodiment of the invention is that the material is collected at nearly the same speed that it is issued, and before the onset of turbulence in the fluid jet. This results in a very uniformly distributed product.

In one embodiment of the present invention, the nozzle outlet can be oriented such that it is directed in the direction of the movement of the collection belt.

In an embodiment of the present invention in which the rotor has multiple nozzles, the nozzles can be spaced apart in the axial direction. The nozzles can be spaced apart from each other such that the material issuing from the nozzles either overlaps or does not overlap with material issuing from adjacent nozzles, depending on the desired product. In one embodiment of the invention, it has been found that when the width of the fan jets is held constant and the distance between the openings is approximately the width of an individual material-carrying fluid jet at the point at which the material is collected on the collection surface (i.e., the width of the material as it is collected) multiplied by a whole number, a very uniform product profile results.

Alternatively, the nozzles can be spaced apart circumferentially around the periphery of the rotor. In this way, more layers can be formed without increasing the rotor height.

When fibrous material is issued from fan jets, the jet orientation can impart general fiber alignment that impacts the balance of properties in the machine and cross directions. In one embodiment of the invention in which multiple nozzles are used, a portion of the jets are angled at between about 20 and 40 degrees from the axial direction, or the axis of the rotor, and a portion of the jets are angled at the same angle in the opposite direction relative to the axis. Having a portion of the jets oriented at opposite angles from each other relative to the rotor axis provides a resulting product having less directionality and more balance in its properties.

Figure 2:
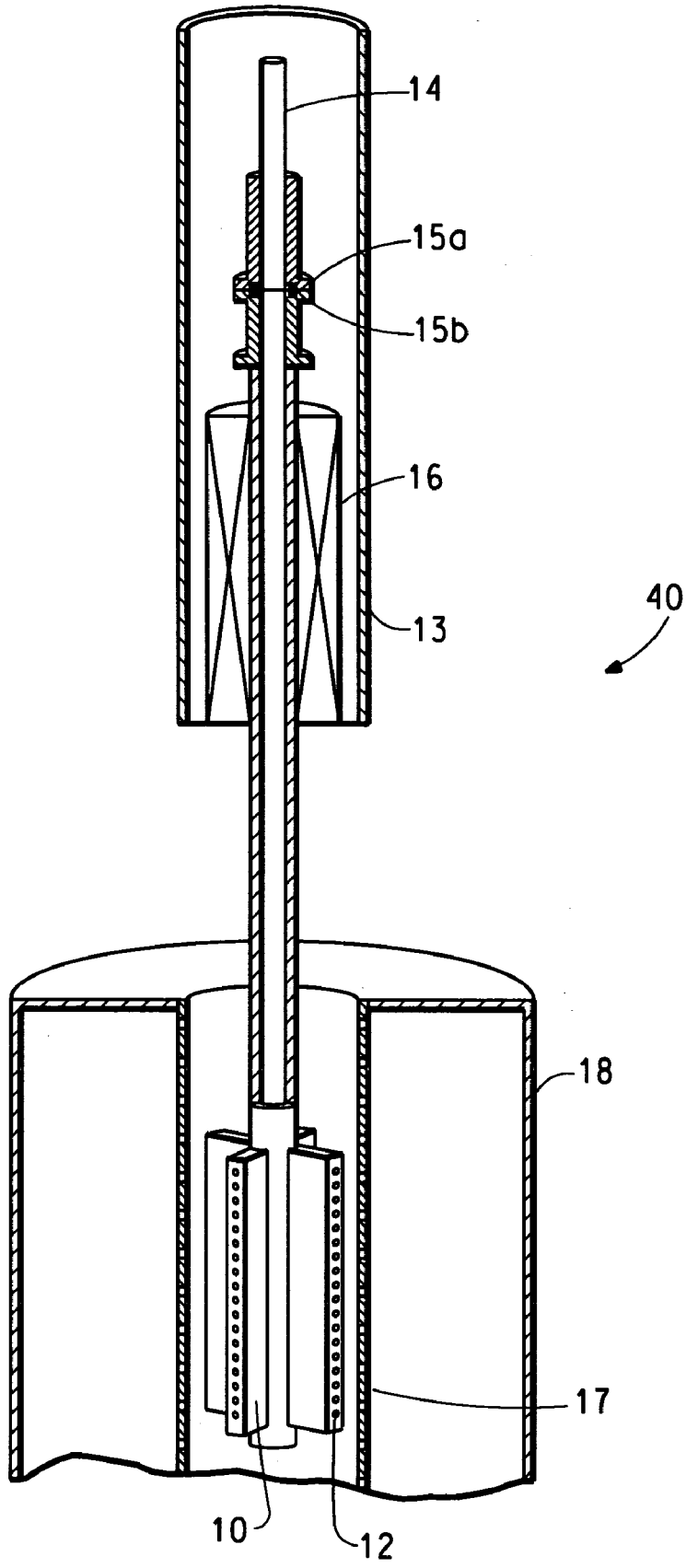
FIG. 2 is a cross-section of an apparatus, including a rotor and a collection surface, used in the process of the invention.

FIG. 2 illustrates one possible configuration of an apparatus 40 for carrying out the process of the invention which includes the rotor body 10 mounted on a rotating shaft 14 supported by a rigid frame 13. The rotating shaft 14 is hollow so that the fluidized mixture can be supplied to the rotor. Along the periphery of the rotor are openings 12 through which the material is issued. The component(s) of the issued material that do not vaporize upon issuing from the nozzle collect on a moving belt (not shown) passing over a porous collector 17. The collector is surrounded with a vacuum box 18 for pulling a vacuum through the porous collector 17, thereby pinning the issued material onto the collection surface of the moving belt. Along the shaft 14 there is a rotary seal comprising a stationary portion 15*a* and a rotating portion 15*b*, and a bearing 16.

The nozzle design can affect the distribution of mass issuing from the nozzle and thereby contribute to the uniformity of material laydown. The spreading of the fluid jet results in the spreading of the issued, solidified web, to the degree that the transverse fibers of the web allow. In general, the greater the width of the issued web, the more uniform the product when collected. There are, however, practical considerations limiting the desired width, such as space limitations, as would be apparent to the skilled artisan.

When the material being issued comprises a polymer, the temperature of the nozzle is preferably maintained at a level at least as high as the melting temperature or softening point of the polymer. The nozzle can be heated by any known method, including electrical resistance, heated fluid, steam or induction heating.

The carrying jets issuing from the nozzles can be free or unconstrained on one side, free on both sides, or constrained on both sides for a certain distance upon issuing from the nozzles. The jets can be constrained on one or both sides by plates installed parallel to the outlet slot of the nozzle, preferably "upstream" to or in advance of the slot, from a stationary vantage point outside the rotor relative to the rotation of the rotor. These act as coanda foils, so that the carrying jet attaches itself to the foil by way of a low pressure zone formed adjacent the foil which guides the jet. In this way, the carrying jet is prevented from mixing with the atmosphere on the side(s) constrained by the foil, as occurs when the jet is free. Thus the use of a foil results in a higher speed jet. This has the same effect as reducing the distance between the nozzle outlet and the collector, in that the material is propelled to the collector before the onset of turbulence in the jet.

The foil can be stationary or can be caused to vibrate. A vibrating foil would enhance product formation since it would help to oscillate at high speed the material being laid down. This would be particularly helpful at lower rotational speeds to counter the overfeed of the issued material. The foil is advantageously as least as wide as the spread width of the web as the web leaves the foil.

Several types of fluidized mixtures can be supplied according to the process of the invention. By "fluidized mixture" is meant a composition in the liquid state or any fluid at greater than its critical pressure, the mixture comprising at least two components. The fluidized mixture can be a homogeneous fluid composition, such as a solution of a solute in a solvent, a heterogeneous fluid composition, such as a mixture of two fluids or a dispersion of droplets of one fluid in another fluid, or a fluid mixture in compressed vapor phase. A fluidized mixture suitable for use in the process of the invention can comprise a solution of a polymer in a spin agent, as described below. The fluidized mixture can comprise a dispersion or suspension of solid particles in a fluid, or a mixture of solid material in a fluid. In another embodiment of the present invention, the material is a solid-fluid fluidized mixture. The process of the invention can be utilized to make paper by supplying a mixture of pulp and water to the rotor and supplying sufficient pressure so that the mixture is propelled from the nozzles to a collector located a certain distance from the rotor. In another embodiment of the present invention, a mixture of a solid material, such as pulp, and a fluid, such as water, is supplied to the rotor at a temperature above the boiling point of the fluid, and at sufficiently high pressure to keep the fluid in liquid state. Upon passing through the nozzle, the fluid vaporizes, propelling and spreading the solid material in the direction of the collection surface. In a preferred embodiment, the environment that the material is propelled into and/or the collection surface is maintained at a temperature near the boiling temperature of the fluid, so that condensation of the fluid is minimized. Advantageously, the environment is maintained at a temperature within about 40° C. of the boiling temperature of the fluid, or even within about 10° C. of the boiling temperature of the fluid. The environment can be maintained above or below the boiling temperature of the fluid.

Polymers which can be utilized in this embodiment of the invention include polyolefins, including polyethylene, low density polyethylene, linear low density polyethylene, linear high density polyethylene, polypropylene, polybutylene, and copolymers of these. Among other polymers suitable for use in the invention are polyesters, including poly(ethylene terephthalate), poly(trimethylene terephthalate), poly(butylene terephthalate) and poly(1,4-cyclohexanedimethanol terephthalate); partially fluorinated polymers, including ethylene-tetrafluoroethylene, polyvinylidene fluoride and ECTFE, a copolymer of ethylene and chlorotrifluoroethylene; and polyketones such as E/CO, a copolymer of ethylene and carbon monoxide, and E/P/CO, a terpolymer of ethylene, polypropylene and carbon monoxide. Polymer blends can also be used in the nonwoven sheet of the invention, including blends of polyethylenes and polyesters, and blends of polyethylenes and partially fluorinated fluoropolymers. All of these polymers and polymer blends can be dissolved in a spin agent to form a solution which is then flash spun into nonwoven sheets of plexifilamentary film-fibrils. Suitable spin agents include chlorofluorocarbons and hydrocarbons. Suitable spin agents and polymer-spin agent combinations which can be employed in the present invention are described in U.S. Pat. Nos. 5,009,820; 5,171,827; 5,192,468; 5,985,196; 6,096,421; 6,303,682; 6,319,970; 6,096,421; 5,925,442; 6,352,773; 5,874,036; 6,291,566; 6,153,134; 6,004,672; 5,039,460; 5,023,025; 5,043,109; 5,250,237; 6,162,379; 6,458,304; and 6,218,460, the contents of which are hereby incorporated by reference. In this embodiment of the invention, the spin agent is at least about 50% by weight of the polymer-spin agent mixture, or at least about 70% by weight of the mixture, and even at least about 85% by weight of the mixture.

Obviously, those of skill in the art will recognize that the design of the nozzles 20 (FIG. 1) may need to be changed to accommodate the various embodiments of liquid mixtures discussed above.

A sheet product can also be formed by supplying a mixture of particles and a fluid to the rotor. In one embodiment, a continuous sheet is formed by spraying liquid droplets containing particles that coalesce on the surface similar to spray painting a surface. In another embodiment, solid particles are sprayed followed by post-coalescence. For example, a suspension of polymer particles obtained by emulsion polymerization or dissolution followed by precipitation of emulsion particles can be formed into a particle sheet. With post processing, the sheet can be transformed into a porous or nonporous sheet in a process similar to powder coating. As noted previously, particles can also be formed in situ by phase separation.

In one embodiment of the invention, the solidified issued material is allowed to fall under the force of gravity and collected in a container. The container should be one that allows the gas to escape. This embodiment is especially suitable when the desired material is in the form of discrete fibrils, discrete particles or polymeric beads.

In an alternate embodiment of the invention, the solidified issued material is collected at a radial distance from the periphery of the rotor on the interior surface, also referred to herein as the "collection surface," of a concentric collector. The collector can be a stationary cylindrical porous structure made from perforated metal sheet or rigid polymer. The collector can be coated with a friction-reducing coating such as a fluoropolymer resin, or it can be caused to vibrate in order to reduce the friction or drag between the collected material and the collection surface. The cylindrical structure is preferably porous so that vacuum can be applied to the material as it is being collected to assist the pinning of the material to the collector. In one embodiment, the cylindrical structure comprises a honeycomb material, which allows vacuum to be pulled on the collected material through the honeycomb material while providing sufficient rigidity not to deform as a result. The honeycomb can further have a layer of mesh covering it to collect the issued material.

Figure 3:
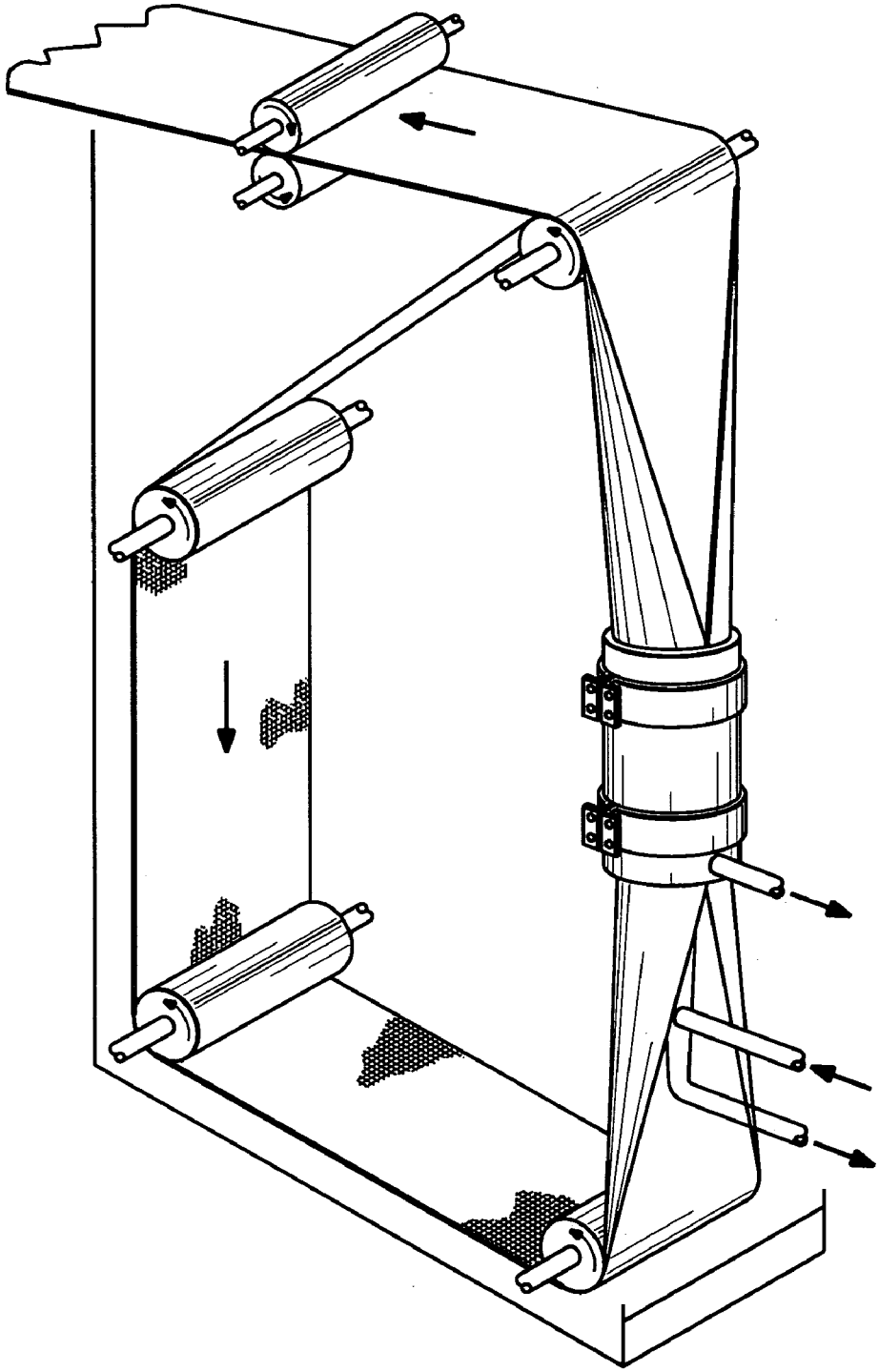
FIG. 3 (PRIOR ART)
FIG. 3 is a perspective drawing illustrating a prior art collection belt suitable for use in the invention.

The collector can alternatively comprise a flexible collection belt moving over a stationary cylindrical porous structure. The collection belt is preferably a smooth, porous material so that vacuum can be applied to the collected material through the cylindrical porous structure without causing holes to be formed in the collected material. The belt can be a flat conveyor belt moving axially to the rotor (in the direction of the axis of the rotor) which deforms to form a concentric cylinder around the rotor and then returns to its flat state upon clearing the rotor, as shown in FIG. 3. In this embodiment of the invention, the cylindrical belt continuously collects the solidified material issuing from the rotor. Such a collection belt is disclosed in U.S. Pat. No. 3,978,976 (Kamp), U.S. Pat. No. 3,914,080 (Kamp), U.S. Pat. No. 3,882,211 (Kamp), and U.S. Pat. No. 3,654,074 (Jacquelin).

The collection surface can alternatively further comprise a substrate such as a woven or a nonwoven fabric moving on the moving collection belt, such that the issued material is collected on the substrate rather than directly on the belt. This is especially useful when the material being collected is in the form of very fine particles.

The collection surface can also be a component of the desired product itself. For instance, a preformed sheet can be the collection surface and a low concentration solution can be issued onto the collection surface to form a thin membrane on the surface of the preformed sheet. This can be useful for enhancing the surface properties of the sheet, such as printability, adhesion, porosity level, and so on. The preformed sheet can be a nonwoven or woven sheet, or a film. In this embodiment, the preformed sheet can even be a nonwoven sheet formed in the process of the invention itself, and subsequently fed through the process of the invention a second time, supported by the collection belt, as the collection surface. In another embodiment of the present invention, a preformed sheet can even be used in the process of the invention as the collection belt itself.

When the material being issued comprises a polymeric material, the gas that is pulled through the collection surface during the process of the present invention can be heated so that a portion of the polymeric material is softened and bonds to itself at points. The gas can be pulled from beyond the ends of the rotor and/or through the rotor itself. Auxiliary gas can be supplied to the cavity between the rotor and the collection surface. When the tangential speed at the periphery of the rotor is greater than about 25% of the issuance speed, the auxiliary gas is advantageously supplied from the rotor itself. The gas is supplied from the rotor by either forcing the gas through the rotor by way of a blower and ductwork, or by incorporating blades into the rotor, or a combination of both. The blades are sized, angled and shaped so as to cause gas flow. Preferably, the blades are designed so that the amount of gas generated by the rotor is approximately equal to the amount of gas being pulled through the collection surface by the vacuum, and can be somewhat more or less depending on the process conditions. The amount of gas entering the rotor can be controlled by enclosing the space surrounding the rotor and collector, also referred to as the "spin cell," and providing an opening to the rotor in the enclosure which can be varied in size.

The gas that is pulled by vacuum through the collection surface can be heated by passing it through a heat exchanger and then returning it to the rotor.

In one embodiment of the invention in which the material being issued comprises a polymeric fibrous material, the material collected on the collection surface is heated sufficiently to bond the material. This can be accomplished by maintaining the temperature of the atmosphere surrounding the collected material at a temperature sufficient to bond the collected material. The temperature of the material can be sufficient to cause a portion of the polymeric fibrous material to soften or become tacky so that it bonds to itself and the surrounding material as it is collected. A small portion of the polymer can be caused to soften or become tacky either by heating the issued material before it is collected sufficiently to melt a portion thereof, or by collecting the material and immediately thereafter, melting a portion of the collected material by way of the heated gas passing therethrough. In this way, the process of the invention can be used to make a self-bonded nonwoven product, wherein the temperature of the gas passing through the collected material is sufficient to melt or soften a small portion of the web but not so high as to melt a major portion of the web.

Advantageously, the space surrounding the rotor and collector, or the spin cell, is enclosed so that the temperature and pressure can be controlled. The spin cell can be heated according to any of a variety of well-known means. For example, the spin cell can be heated by a single means or a combination of means including blowing hot gas into the spin cell, steam pipes within the spin cell walls, electric resistance heating, and the like. Heating of the spin cell is one way to ensure good pinning of the polymeric fibrous material to the collection surface, since polymeric fibers become tacky above certain temperatures.

Heating of the spin cell can also enable the production of nonwoven products which are differentially bonded through the thickness thereof. This can be accomplished by forming a product from layers of polymers having different sensitivities to heat relative to each other. For instance, at least two polymers having different melting or softening temperatures can be issued from separate nozzles. The temperature of the process is controlled at a temperature greater than the temperature at which the lower melting temperature polymeric material becomes tacky, but lower than the temperature at which the higher melting temperature polymer becomes tacky, thus the lower melting polymer material is bonded and the higher melting polymer material remains unbonded. In this way, the higher melting temperature polymer fibers are bonded together with the lower melting temperature polymer fibers as they are formed. The nonwoven is bonded at sites uniformly throughout its thickness. The resulting nonwoven has a high delamination resistance.

A self-bonded polymeric nonwoven product can also be formed by issuing a mixture comprising at least two polymers having different melting or softening temperatures. In one embodiment, one of the polymers, preferably constituting about 5% to about 10% by weight of the polymers in the mixture, has a lower melting or softening temperature than the remaining polymer(s), and the temperature of the issued material exceeds the lower melting or softening temperature, either immediately prior to the material being collected on the collection surface or immediately after the material is collected, such that the lower melting polymer softens or becomes sufficiently tacky to bond the collected material together.

In one embodiment of the present invention, the material supplied to the nozzle is a mixture comprising at least two polymers having different softening temperatures and the temperature of the atmosphere surrounding the material being collected on the collection surface is maintained at a temperature intermediate the softening temperatures of two of the polymers, so that the lower softening temperature polymer(s) softens and or becomes tacky, and the issued material bonds into a coherent sheet.

Various methods can be employed to secure or pin the material to the collector. According to one method, vacuum is applied to the collector from the side opposite the collection surface at a sufficient level to cause the material to be pinned to the collection surface. In the embodiment in which a plexifilamentary web is flash spun, it has been found that vacuum is preferably applied in the range of approximately 3 to approximately 20 inches of water (approximately 0.008 to approximately 0.05 kg/cm$^2$).

As an alternative to pinning the material by vacuum, the material can also be pinned to the collection surface by electrostatic force of attraction between the material and the collector, i.e., between the material and the collection surface, the collecting cylindrical structure, or the collection belt, as the case can be for a particular embodiment of the invention. This can be accomplished by creating either positive or negative ions in the gap between the rotor and the collector while grounding the collector, so that the newly issued material picks up charged ions and thus the material becomes attracted to the collector. Whether to create positive or negative ions in the gap between the rotor and the collector is determined by what is found to more efficiently pin the material being issued.

In order to create positive or negative ions in the gap between the rotor and the collection surface, and thus to positively or negatively charge the solidified issued material passing through the gap, one embodiment of the process of the present invention employs a charge-inducing element installed on the rotor. The charge-inducing element can comprise pin(s), brushes, wire(s) or other element, wherein the element is made from a conductive material such as metal or a synthetic polymer impregnated with carbon. A voltage is applied to the charge-inducing element such that an electric current is generated in the charge-inducing element, creating a strong electric field in the vicinity of the charge-inducing element which ionizes the gas in the vicinity of the element thereby creating a corona. The amount of electrical current necessary to be generated in the charge-inducing element will vary depending on the specific material being processed, but the minimum is the level found to be necessary to sufficiently pin the material, and the maximum is the level just below the level at which arcing is observed between the charge-inducing element and the grounded collection belt. In the case of flash spinning a polyethylene plexifilamentary web, a general guideline is that the material pins well when charged to approximately 8 μ-coulombs per gram of web material. Voltage is applied to the charge-inducing element by connecting the charge-inducing element to a power supply. The farther from the collector the material is being issued, the higher the voltage must be to achieve equivalent electrostatic pinning force. In order to apply the voltage generated at the stationary power supply to the charge-inducing elements installed on the spinning rotor, a slip ring can be included within the rotor.

In one preferred embodiment, the charge-inducing elements used are conductive pins or brushes which are directed at the collector and which can be recessed in the rotor periphery so that they do not protrude into the gap between the rotor and the collection surface. The charge-inducing elements are located "downstream" from the nozzles or subsequent to the nozzles, from a stationary vantage point outside the rotor relative to as the rotation of the rotor, so that material is issued from the nozzles and is subsequently charged by the charge-inducing elements.

In an alternate embodiment, the charge-inducing elements are pins or brushes which are installed in the rotor such that they are located tangential to the surface of the rotor and are directed towards the material as it is issued from the nozzles.

When the charge-inducing elements are pins, they preferably comprise conductive metal. One or more pins can be used. When the charge-inducing elements are brushes, they can comprise any conductive material. Alternatively, wire such as piano wire can be used as the charge-inducing element.

In an alternate embodiment of the present invention also in which electrostatic force is used to pin the material, conductive elements such as pins, brushes or wires installed on the rotor are grounded by way of a connection through a slip ring, and the collector belt is connected to the power supply. The collection belt comprises any conductive material that does not generate a back corona, a condition in which gas particles are charged with the wrong polarity, thus interfering with pinning.

In another alternate embodiment of the invention, the collection belt is non-conductive and is supported by a support structure that comprises a conductive material. In this embodiment, the support structure is connected to the power supply and the rotor is grounded.

If positive ions are desired so that the material is positively charged, then a negative voltage is applied to the collector. If negative ions are desired, then a positive voltage is applied to the collector.

In one embodiment of the present invention, a combination of vacuum pinning and electrostatic pinning is used to ensure that the material is efficiently pinned to the collection surface.

If the material is polymeric and is heated sufficiently to self bond, as already described herein, the material may form a coherent sheet or film on the collection surface without the application of vacuum or electrostatic forces.

Another means of ensuring that the material is pinned to the collection surface is the introduction of a fogging fluid into the gap between the rotor and the collection surface. In this embodiment, the fogging fluid comprising a liquid is issued from nozzle(s) which can be of the same type as the material-issuing nozzles. Such a nozzle is referred to herein as a "fogging jet." The fogging jets issue a mist of liquid droplets which assist the fibers in laying down on the collection surface. Advantageously, there is one fogging jet for each material-issuing nozzle. The fogging jet is located adjacent the nozzle so that the mist issuing therefrom is introduced directly into the carrying jet issuing from the nozzle and some liquid droplets are entrained with the carrying jet and contact the web. The mist of liquid issuing from the fogging jets can also serve to provide added momentum to the issued material and reduce the level of drag that the issued material encounters before laying down on the collection surface.

The ratio of the tangential speed at the periphery of the rotor to the speed of the jet issuing from the nozzle, also referred to herein as the "lay-down/issuance ratio," can be any value up to 1, advantageously between about 0.01 and 1, and even between about 0.5 and 1. The closer these two speeds are to one another, i.e., the closer the lay-down/issuance ratio is to 1, the more evenly distributed and uniform are the layers of collected material. It has been found that the uniformity of the collected material can be improved by reducing the mass throughput per nozzle.

The collection belt speed and the throughput of the rotor can be selected in order to achieve a desired basis weight of the product. The number of nozzles in the rotor and the rotational speed of the rotor are selected to achieve the desired number of web layers in the collected material and the thickness of each web layer. For a given desired basis weight, there are thus two ways to increase the number of web layers: The number of nozzles in the rotor can be increased, while the throughput per nozzle is decreased proportionally in order to keep the basis weight constant; or by increasing the rotational speed of the rotor.

When a polymer solution is flash spun according to the present invention, the concentration of the solution affects the polymer throughput per nozzle. The lower the polymer concentration, the lower the polymer mass throughput. The throughput per nozzle can also be varied by changing the size of the nozzle orifice, as would be apparent to the skilled artisan.

The products made by the process of the invention include but are not limited to nonwoven sheets, discrete particles, porous or continuous membranes formed from the coalescence of discrete particles, and combinations thereof, and polymeric beads. When a nonwoven sheet is formed, the process of the invention results in a product having surprisingly uniform basis weight. Products having a machine direction uniformity index (MD UI) of less than about 14 $(oz/yd^2)^{1/2}$ (82 $(g/m^2)^{1/2}$) can be made, even less than about 8 $(oz/yd^2)^{1/2}$ (47 $(g/m^2)^{1/2}$) and even less than about 4 $(oz/yd^2)^{1/2}$ (23 $(g/m^2)^{1/2}$). The product is more uniform since each web layer is very thin. A great number of thin web layers, regardless of the nonuniformities of each layer, results in insensitivity to those nonuniformities, and yields a more uniform product than a product having fewer layers of equivalent uniformity.

Among the products that can be obtained by the process of the present invention is a fibrous nonwoven sheet having improved properties, most particularly a combination of high tensile strength to basis weight ratio, high elongation and high basis weight uniformity. The sheet can be formed to have a tensile strength to basis weight ratio of greater than about 15 lb/in/oz/yd$^2$ (0.78 N/cm/g/m$^2$) and an elongation to break of greater than about 15%. The machine direction uniformity index (MD UI) of the sheet formed can be less than about 14 $(oz/yd^2)^{1/2}$ (82 $(g/m^2)^{1/2}$), even less than about 8 $(oz/yd^2)^{1/2}$ (47 $(g/m^2)^{1/2}$), and even less than about 4 $(oz/yd^2)^{1/2}$ (23 $(g/m^2)^{1/2}$). The basis weight of the sheet can vary between about 0.5 and 2.5 oz/yd$^2$ (17–85 g/m$^2$) and the thickness of the resulting sheet can vary between about 50 and 380 pm. The sheet can have a Frazier air permeability of at least about 5 CFM/ft$^2$ (1.5 m$^3$/min/m$^2$), and a hydrostatic head (HH) of at least about 10 inches (25 cm). The sheet preferably is made up of between about 10 and 500 layers of fibrous web material. Advantageously, the fibrous nonwoven sheet comprises flash spun plexifilamentary film-fibril material, preferably high density polyethylene.

TEST METHODS

In the non-limiting examples that follow, the following test methods were employed to determine various reported characteristics and properties. ASTM refers to the American Society of Testing Materials. ISO refers to the International Standards Organization. TAPPI refers to Technical Association of Pulp and Paper Industry.

Basis weight was determined by ASTM D-3776, which is hereby incorporated by reference and reported in oz/yd$^2$.

The Machine Direction Uniformity Index (MD UI) of a sheet is calculated according to the following procedure. A beta thickness and basis weight gauge (Quadrapac Sensor by Measurex Infrand Optics) scans the sheet and takes a basis weight measurement every 0.2 inches (0.5 cm) across the sheet in the cross direction (CD). The sheet then advances 0.42 inches (1.1 cm) in the machine direction (MD) and the gauge takes another row of basis weight measurements in the CD. In this way, the entire sheet is scanned, and the basis weight data is electronically stored in a tabular format. The rows and columns of the basis weight measurements in the table correspond to CD and MD "lanes" of basis weight measurements, respectively. Then each data point in column 1 is averaged with its adjacent data point in column 2; each data point in column 3 is averaged with its adjacent data point in column 4; and so on. Effectively, this cuts the number of MD lanes (columns) in half and simulates a spacing of 0.4 inch (1 cm) between MD lanes instead of 0.2 inch (0.5 cm). In order to calculate the uniformity index (UI) in the machine direction ("MD UI"), the UI is calculated for each column of the averaged data in the MD. The UI for each column of data is calculated by first calculating the standard deviation of the basis weight and the mean basis weight for that column. The UI for the column is equal to the standard deviation of the basis weight divided by the square root of the mean basis weight, multiplied by 100. Finally, to calculate the overall machine direction uniformity index (MD UI) of the sheet, all of the UI's of each column are averaged to give one uniformity index. The units for uniformity index are (ounces per square yd)$^{1/2}$.

Frazier Air Permeability (or Frazier Permeability) is a measure of air permeability of porous materials and is measured in cubic feet per minute per square foot. It measures the volume of air flow through a material at a differential pressure of 0.5 inches water (1.3 cm of water). An orifice is mounted in a vacuum system to restrict flow of air through sample to a measurable amount. The size of the orifice depends on the porosity of the material. Frazier permeability, which is also referred to as Frazier porosity, is measured using a Sherman W. Frazier Co. dual manometer with calibrated orifice units in ft$^3$/ft$^2$/min.

Hydrostatic Head (HH) is a measure of the resistance of the sheet to penetration by liquid water under a static load. A 7 inch by 7 inch (18 cm by 18 cm) sample is mounted in a SDL 18 Shirley Hydrostatic head tester (manufactured by Shirley Developments Limited, Stockport, England). Water is pumped against one side of a 103-cm$^2$ section of the sample at a rate of 60+/−3 m$^3$/min until three areas of the sample are penetrated by the water. The hydrostatic head is measured in inches. The test generally follows ASTM D 583 which was withdrawn from publication in November, 1976. A higher number indicates a product with greater resistance to liquid passage.

Elongation-to-Break (also referred to herein as "Elongation") of a sheet is a measure of the amount a sheet stretches prior to breaking in a strip tensile test. A 1-inch (2.5 cm) wide sample is mounted in the clamps, set 5 inches (13 cm) apart, of a constant rate of extension tensile testing machine such as an Instron table model tester. A continuously increasing load is applied to the sample at a crosshead speed of 2 inches/min (5.1 cm/min) until failure. The measurement is given in percentage of stretch prior to failure. The test generally follows ASTM D 5035-95.

Surface Area is calculated from the amount of nitrogen absorbed by a sample at liquid nitrogen temperatures by means of the Brunauer-Emmet-Teller equation and is given in $m^2/g$. The nitrogen absorption is determined using a Stohlein Surface Area Meter manufactured by Standard Instrumentation, Inc., Charleston, W.Va. The test method applied is found in the J. Am. Chem. Soc., V. 60 p. 309–319 (1938).

Fiber Tenacity and Fiber Modulus was determined with an Instron tensile-testing machine. The sheet was conditioned and tested at 70° F. (21° C.) and 65% relative humidity. The sheet was twisted to 10 turns per inch (2.54 cm) and mounted in the jaws of the Instron Tester. A two-inch (5.08 cm) gauge length was used with an initial elongation rate of 4 inches (20.3 cm) per minute. The tenacity at break is recorded in grams per denier (gpd). Modulus corresponds to the slope of the stress/strain curve and is expressed in units of gpd.

EXAMPLE 1

A polymeric solution of 1% Mat 8, Blue high density polyethylene (obtained from Equistar Chemicals LP) in a spin agent of Freon® 11 (obtained from Palmer Supply Company) at a temperature of 180° C. and a filter pressure of 2040 psi (14 MPa) was flash spun through a nozzle in a rotor having a diameter of 16 inches (41 cm) and a height of 3.6 inches (9.2 cm) rotating at 1000 rpm onto a leader sheet of white Sontara® fabric (available from E. I. du Pont de Nemours & Company, Inc.) on a porous collection belt. The outlet slot of the nozzle was oriented at a 30° angle away from the axis of the rotor. The flash spun material was discharged from the nozzle in the radial direction away from the rotor. The distance between the outlet of the nozzle and the collection belt was 1 inch (2.5 cm). The rotor was enclosed in a spin cell and the interior of the spin cell was maintained at a temperature of 50° C.

Electrostatic force was generated from 5 needles spaced evenly in a row just downstream of the nozzle. Each nozzle was grounded through the rotor. The needles therefore were also grounded through the rotor. The needles were spaced one inch from the surface of the collection belt. The collection belt was electrically isolated and brought to a negative voltage of 30 to 50 kV. The power supply was run in current control mode, thus the current remained steady at 0.20 mA.

Vacuum was applied to the collection belt by means of a vacuum blower in fluid communication with the collection belt via ductwork. Electrostatic force and vacuum were employed simultaneously to assist with the pinning of the flash spun web to the collector.

The mean fiber surface area of the collected material was measured to be 4.7 $m^2/g$. The material had a Frazier air permeability of 66.6 $CFM/ft^2$ (20 $m^3/min/m^2$). The uniformity index and basis weight are shown in Table 1.

EXAMPLE 2

A polymeric solution of 11% high density polyethylene (80% Mat 8 obtained from Equistar Chemicals LLP, having a melting temperature of about 138° C., and 20% Dow 50041 obtained from Dow Chemical, Inc., having a melting temperature of about 128° C.) in a spin agent of Freon® 11 (obtained from Palmer Supply Company) at a temperature of 190° C. and a filter pressure of 2030 psi (14 MPa) was flash spun through a nozzle in the rotor used in Example 1 rotating at 1000 rpm onto a belt of Reemay® Style 2014 fabric (obtained from Specialty Converting). The outlet slot of the nozzle was oriented axially to the rotor. The distance between the outlet of the nozzle and the collection belt was 1.5 inch (3.8 cm). The rotor was enclosed in a spin cell and the interior of the spin cell was maintained at a temperature of 125° C.

Vacuum was employed to assist with the pinning of the flash spun web to the collector.

An aerodynamic stainless steel foil extending 0.5 inch (1.3 cm) in the radial direction was installed on the periphery of the rotor adjacent the outlet slot of the nozzle on the upstream side of the nozzle. The foil was used to ensure that the jet velocity remained high after leaving the nozzle. The foil used protruded 0.5 inch (1.3 cm) from the face of the nozzle, thus creating an effective spin distance of 1.0 inch (2.5 cm), since the jet velocity at 1.5 inch (3.8 cm) is nearly equivalent to the jet velocity if the exit of the nozzle were 1.0 inch (2.5 cm) to the collector surface.

The collected material had a tensile strength in the machine direction of 6.2 lb/in (10.8 N/cm) and in the cross direction of 1.4 lb/in (2.4 N/cm), an elongation in the machine direction of 15.3% and in the cross direction of 12.4%. The uniformity index and basis weight are shown in Table 1.

EXAMPLE 3

A polymeric solution of 11% Mat 8 high density polyethylene in a spin agent of Freon® 11 (obtained from Palmer Supply Company) at a temperature of 190° C. and a filter pressure of 2110 psi (14 MPa) was flash spun through a nozzle in a rotor rotating at 158 rpm onto a belt of Sontara® 8010 fabric (available from E. I. du Pont de Nemours & Company, Inc.) moving at 5.4 yards per minute (4.9 m/min). The outlet slot of the nozzle was oriented axially to the rotor. The distance between the outlet of the nozzle and the collection belt was 1.5 inch (3.8 cm). The rotor was enclosed in a spin cell and the interior of the spin cell was maintained at a temperature of 120° C.

Electrostatic force and vacuum were employed simultaneously to assist with the pinning of the flash spun web to the collector. The electrostatic force in this example was generated from conductive brushes and from the serrated edge of the aerodynamic foil. Electrostatic brushes were installed on each end of the rotor along the outer periphery of the rotor. The edge of the aerodynamic foil closest to the collector was serrated to create sharp points from which corona could be generated. The collector was electrically isolated and brought to a negative voltage of 20 to 50 kV. The power supply was run in current control mode, thus the current remained steady at 3.0 mA. Vacuum was applied at 30–40 inches of $H_2O$ (76–102 cm of water).

An aerodynamic foil as described in Example 2, extending 0.5 inch (1.3 cm) in the radial direction was installed on the periphery of the rotor adjacent the outlet slot of the nozzle on the upstream side of the nozzle.

The uniformity index of the collected material is shown in Table 1.

EXAMPLE 4

A polymeric solution of 11% Mat 8 high density polyethylene in a spin agent of Freon® 11 (obtained from Palmer Supply Company) at a temperature of 190° C. and a filter pressure of 2100 psi (14 MPa) was flash spun through a nozzle in a rotor rotating at 156 rpm onto a belt of Sontara® 8010 fabric. The outlet slot of the nozzle was oriented axially to the rotor. The distance between the outlet of the nozzle and the collection belt was 0.75 inch (1.9 cm). The rotor was enclosed in a spin cell and the interior of the spin cell was maintained at a temperature of 120° C.

Electrostatic force and vacuum were employed simultaneously to assist with the pinning of the flash spun web to the collector. The electrostatic force in this example was generated from 18 needles situated on either side of the fan jet on both the nozzles. The nozzles were grounded through the rotor. The needles therefore were also grounded. The needles on the nozzles were 0.75 inches from the collector. The collector was electrically isolated and brought to a negative voltage of 10 to 30 kV. The power supply was run in current control mode, thus the current remained steady at 0.72 mA. Vacuum was applied at 26–34 inches of $H_2O$ (66–86 cm of water).

The collected material had a fiber modulus of 15.9 g/denier (14.0 dN/tex), a fiber tenacity of 2.9 g/denier (2.56 dN/tex) and a fiber elongation 20.4%.

EXAMPLE 5

A polymeric solution of 11% high density polyethylene (80% Mat 8 obtained from Equistar Chemicals LLP and 20% Dow 50041 obtained from Dow Chemical, Inc.) in a spin agent of Freon® 11 (obtained from Palmer Supply Company) at a temperature of 190° C. and a filter pressure of 2100 psi (14 MPa) was flash spun through a nozzle in a rotor rotating at 158 rpm onto a belt of Typar® fabric (obtained from E. I. du Pont de Nemours & Company, Inc.). The outlet slot of the nozzle was oriented at a 20° angle to the rotor. The distance between the outlet of the nozzle and the collection belt was 1 inch (2.5 cm). The rotor was enclosed in a spin cell and the interior of the spin cell was maintained at a temperature of 115–120° C.

Vacuum was applied at 20–35 inches of $H_2O$ (51–89 cm of water) to the collection fabric to assist in the collection of the flash spun material.

The collected material had a basis weight of 0.83 oz/yd$^2$ (28 g/m$^2$).

EXAMPLE 6

A polymeric solution of 1% Mat 8 high density polyethylene in a spin agent of Freon® 11 (obtained from Palmer Supply Company) at a temperature of 190° C. and a filter pressure of 2060 psi (14 MPa) was flash spun through a nozzle in a rotor rotating at 154 rpm onto a belt of blue Sontara® fabric (style no. 8830). The outlet slot of the nozzle was oriented axially to the rotor. The distance between the outlet of the nozzle and the collection belt was 3 inches (7.6 cm). The rotor was enclosed in a spin cell and the interior of the spin cell was maintained at a temperature of 60° C.

Electrostatic force and vacuum were employed simultaneously to assist with the pinning of the flash spun web to the collector. Metal needles located on the nozzle were grounded to the rotor body. The collector surface was electrically isolated from ground and brought to a negative voltage of 30 to 40 kV by attaching a high voltage power supply to the isolated collector. The power supply was run in current control mode, thus the current remained steady at 0.30 mA. The negative voltage on the collector generated a positive corona from the grounded electrostatic needles. Polymer fibers became positively charged as they came in contact with positive ions generated from the positive corona. Vacuum was applied at 3–5 inches of $H_2O$ (8–13 cm of water). The collected material had a basis weight and a MD UI as reported in Table 1.

EXAMPLE 7

A polymeric solution of 2% Mat 8 high density polyethylene in a spin agent of Freon® 11 (obtained from Palmer Supply Company) at a temperature of 180° C. and a filter pressure of 2000 psi (14 MPa) was flash spun through a nozzle in a rotor rotating at 1015 rpm onto a belt of Typar® fabric. The outlet slot of the nozzle was oriented at a 32° angle to the rotor. The distance between the outlet of the nozzle and the collection belt was 1 inch (2.5 cm). The rotor was enclosed in a spin cell and the interior of the spin cell was maintained at a temperature of 60° C.

The rotor had metal pumping vanes around its circumference, which generate a gas flow in the annulus between the collector and the rotor. Gas is brought into the rotor from both the top and the bottom sides of the rotor and exits through the pumping vanes such that the tangential component of the speed of the gas is equal to the tangential speed of the rotor, and the direction of the gas flow is the same as the direction of the rotation of the rotor.

The pumping vanes were electrically grounded to the rotor body. Tack welded to every other metal vane was a row of electrostatic needles, which were in turn grounded to the rotor body. There were 7 needles on the first two pumping vanes downstream of each nozzle, and then needles were attached on every other vane thereafter. 24 vanes in all had 7 needles per vanes for a total of 168 needles. Needles were also on the nozzle (5 needles per nozzle). The collector surface was electrically isolated from ground and brought to a negative voltage of 20 to 50 kV by attaching a high voltage power supply to the isolated collector. The power supply was run in current control mode, thus the current remained steady at each of the settings, 3.0 mA, 3.5 mA and 4.0 mA. The negative voltage on the collector generated a positive corona from the grounded electrostatic needles. Polymer fibers became positively charged as they came into contact with positive ions generated from the positive corona.

Electrostatic force and vacuum were employed simultaneously to assist with the pinning of the flash spun web to the collector. Vacuum was applied at 19–40 inches of $H_2O$ (48–102 cm of water).

The uniformity index of the collected material is shown in Table 1.

EXAMPLE 8

A polymeric solution of 2% Mat 8 high density polyethylene in a spin agent of Freon® 11 (obtained from Palmer Supply Company) at a temperature of 180° C. and a filter pressure of 1970 psi (14 MPa) was flash spun through a nozzle in a rotor rotating at 1014 rpm onto a belt of Typar® fabric. The outlet slot of the nozzle was oriented at a 32° angle to the rotor. The distance between the outlet of the nozzle and the collection belt was 1 inch (2.5 cm). The rotor was enclosed in a spin cell and the interior of the spin cell was maintained at a temperature of 60° C.

As in Example 7, electrostatic force and vacuum were employed simultaneously to assist with the pinning of the flash spun web to the collector. The rotor had metal pumping vanes around its circumference as in Example 7. Vacuum was applied at 15–32 inches of $H_2O$ (38–81 cm of water).

The fiber surface area of the collected material was measured to be 1.7 $m^2/g$. The Frazier air permeability of the unbonded collected material was found to be 8 CFM/$ft^2$ (2.4 $m^3/min/m^2$) and the hydrostatic head was 22 inches of water (56 cm of water). The collected material was bonded using a hot press at 142° C. for 3 seconds. The bonded collected material was found to have a tensile strength of 1.4 lb/in (2.4 N/cm) in the machine direction and 1.2 lb/in (2.1 N/cm) in the cross direction, and an elongation of 16% in the machine direction and 19% in the cross direction. The Frazier air permeability and the hydrostatic head of the bonded collected material were found to be the same as before the bonding process. The uniformity index and basis weight of the collected material is shown in Table 1.

EXAMPLE 9

A polymeric solution of 12% Mat 8 high density polyethylene in a spin agent of Freon® 11 (obtained from C.C. Dickson Company) at a temperature of 180° C. and a filter pressure of 1850 psi (13 MPa) was flash spun through a nozzle in a rotor rotating at 500 rpm onto a belt of Reemay® fabric. The outlet slot of the nozzle was oriented at a 20° angle to the rotor. The distance between the outlet of the nozzle and the collection belt was 1 inch (2.5 cm). The rotor was enclosed in a spin cell and the interior of the spin cell was maintained at a temperature of 115° C.

Electrostatic force and vacuum were employed simultaneously to assist with the pinning of the flash spun web to the collector. The electrostatic force in this example was generated from the points of a stationary swath charger, which consisted of three 60-point circular blades located below the rotor and positioned so that the points were located a 1-inch distance from the collector. The rotor was grounded electrically. In this case the collector was electrically isolated and grounded. The swath charger too was electrically isolated and brought to a positive voltage of 20 to 50 kV. The power supply was run in current control mode, thus the current remained steady at each of the settings used: 3.0 mA, 3.5 mA and 4.0 mA. Vacuum was applied at 10.5 inches of $H_2O$ (26.7 cm of water).

The ambient air in the spin cell was heated to 115° C. using steam heating in the walls of the enclosure.

In this example, the bottom surface of the rotor was covered with Nomex® paper (available from E. I. du Pont de Nemours and Company, Wilmington, Del.). This paper prevented gas from entering the rotor from below the rotor; however it did not prevent gas from reaching the pumping vanes themselves.

The uniformity index and basis weight of the collected material is shown in Table 1.

EXAMPLE 10

A polymeric solution of 12% Mat 8 high density polyethylene in a spin agent of Freon® 11 (obtained from C.C. Dickson Company) at a temperature of 180° C. and a filter pressure of 1730 psi (12 MPa) was flash spun through a nozzle in a rotor rotating at 1000 rpm onto a belt of Reemay® fabric. The outlet slot of the nozzle was oriented at a 200 angle to the rotor. The rotor was enclosed in a spin cell and the interior of the spin cell was maintained at a temperature of 115° C.

Electrostatic force and vacuum were employed simultaneously to assist with the pinning of the flash spun web to the collector. The electrostatic force was generated as in Example 9, using the stationary swath charger. The ambient air in the spin cell was heated to 115° C. using steam heating in the walls of the enclosure. Vacuum was applied at 3.32 inches of $H_2O$ (8.43 cm of water).

The basis weight of the collected material was 0.36 oz/yd (12 $g/m^2$).

EXAMPLE 11

A polymeric solution of 2% Mat 6 polymer, high density polyethylene (obtained from Equistar Chemicals LP) in a spin agent of Freon® 11 (obtained from C.C. Dickson) was flash spun through a nozzle in a rotor, at a temperature of 170° C. and a filter pressure of 1800 psi (12.41 MPa). The rotor had a diameter of 20 inches (51 cm) and a height of 3.5 inches (8.9 cm), and rotated at 2000 rpm. The web formed was spun onto a porous, conductive nylon belt (manufactured by Albany International). The web sample was covered by a leader sheet of 36 inch (91 cm) wide Anti-Stat Reemay® (available from E. I. du Pont de Nemours & Company, Inc.). The outlet slot of the nozzle was oriented axially to the rotor. The flash spun web material was discharged from the nozzle in the radial direction away from the rotor. The distance between the outlet nozzle and the collection belt was approximately 1 inch (2.5 cm). The rotor was enclosed in a spin cell and the interior of the spin cell was maintained at a temperature between about 70° C. and about 77° C.

An aerodynamic stainless steel foil extending 0.34 in (0.86 cm) in the radial direction was installed adjacent to the outlet slot of the nozzle on the upstream side of the nosecone. The foil used was sloped at a 15° angle, and it protruded 0.34 in (0.86 cm) from the face of the nozzle. The foil measured 3 inches (7.6 cm) in the axially direction.

Electrostatic force was generated from four evenly spaced rows that contained charging needles. The rows each contained 7 evenly spaced needles. Two rows were positioned several inches downstream from the spinning nozzle. The collection belt was grounded. The needles were spaced 1 inch (2.5 cm) from the collection belt. The needles were electrically charged and brought to a voltage of 24 to 27 kV. The current remained steady at 50 μA.

Vacuum was applied to the collection belt by means of a vacuum blower in fluid communication with the collection belt via ductwork. The vacuum blower operated at 3400 rpm creating a 40 psig (0.26 MPa) pressure drop across the vacuum blower. Electrostatic force and vacuum pinning were employed simultaneously to assist with the pinning of the flash spun web to the collector. The MD UI and basis weight for the flash spun fabric of Example 11 are reported in Table 1.

TABLE 1

| | MD UI | | Basis Wt. | |
|---|---|---|---|---|
| Example | $(oz/yd^2)^{1/2}$ | $(g/m^2)^{1/2}$ | $oz/yd^2$ | $(g/m^2)$ |
| 1 | 5 | (29) | 0.76 | (26) |
| 2 | 12 | (70) | 0.72 | (24) |

TABLE 1-continued

| Example | MD UI $(oz/yd^2)^{1/2}$ | MD UI $(g/m^2)^{1/2}$ | Basis Wt. $oz/yd^2$ | Basis Wt. $(g/m^2)$ |
|---|---|---|---|---|
| 3 | 16 | (93) | 0.87 | (29) |
| 6 | 10.4 | (61) | 0.41 | (14) |
| 7 | 8 | (47) | 1.2 | (41) |
| 8 | 3 | (17) | 1.2 | (41) |
| 9 | 16 | (93) | 0.34 | (11) |
| 11 | 2.2 | (13) | 0.28 | (9.5) |

Accordingly, it is clear from the data in Table 1 that the new process disclosed herein achieves much improved machine direction uniformity indices for flash spun plexifilamentary fabrics.

We claim:

1. A process comprising the steps of:

supplying a fluidized mixture having at least two components at a pressure greater than atmospheric pressure to a rotor spinning about an axis at a rotational speed, the rotor having at least one material-issuing nozzle comprising an opening therein along the periphery of the rotor;

issuing the fluidized mixture from the opening of the nozzle at a reduced pressure relative to that in the supplying step to form an issued material at a material issuance speed;

vaporizing or expanding at least one component of the issued material to form a fluid jet; and transporting the remaining component(s) of the issued material away from the rotor by the fluid jet.

2. The process of claim 1, wherein the fluidized mixture comprises at least about 50% by weight of a spin agent, and wherein the fluidized mixture is issued at a temperature greater than the boiling temperature of the spin agent.

3. The process of claim 2, wherein the fluidized mixture comprises at least about 70% by weight of a spin agent.

4. The process of claim 1, wherein the fluidized mixture comprises a compressed vapor.

5. The process of claim 1, wherein the fluid jet is issued at a speed of at least about 30 meters per second.

6. The process of claim 1, wherein one component comprises a spin agent, further comprising supplying the fluidized mixture to the rotor at a temperature greater than the boiling temperature of the spin agent at a pressure sufficient to keep the spin agent in liquid state, and issuing the fluidized mixture from the opening into an environment at a temperature within about 40° C. of the boiling temperature of the spin agent such that the spin agent vaporizes and a solidified second component is propelled from the nozzle.

7. The process of claim 6, wherein the fluidized mixture is issued into an environment at a temperature within about 10° C. of the boiling temperature of the spin agent.

8. The process of claim 1, further comprising collecting the remaining component(s) of the issued material on a collection surface of a collection belt concentric to the axis of the rotor to form a collected material, the collection belt moving in a direction parallel to the axis of rotation of the rotor at a collection belt speed.

9. The process of claim 8, further comprising selecting the rotational speed and the collection belt speed so that the component(s) collected on the collection surface comprise multiple layers.

10. The process of claim 1, wherein the at least one material-issuing nozzle spreads the issued material primarily in the axial direction.

11. The process of claim 1, wherein the at least one material-issuing nozzle spreads the issued material primarily in a non-axial direction.

12. The process of claim 1, wherein the at least one material-issuing nozzle directs the issued material primarily in the radial direction.

13. The process of claim 1, wherein the at least one material-issuing nozzle directs the issued material primarily in a non-radial direction.

14. The process of claim 8, wherein the at least one material-issuing nozzle directs the issued material in the direction of the movement of the collection belt.

15. The process of any of claims 1–14, wherein the at least one material-issuing nozzle comprises a fan jet.

16. The process of claim 1, wherein the rotor has two or more material-issuing nozzles comprising openings therein along the periphery of the rotor.

17. The process of claim 16, wherein the material-issuing nozzles are spaced apart axially.

18. The process of claim 16, wherein the material-issuing nozzles are spaced apart circumferentially.

19. The process of claim 1, wherein the ratio of the tangential speed at the periphery of the rotor to the material issuance speed is less than or equal to 1.

20. The process of claim 8, further comprising applying vacuum to the collection belt on the side opposite the collection surface.

21. The process of claim 8 or claim 20, further comprising creating an electrical potential between the remaining component(s) of the issued material and the collection surface.

22. The process of claim 21, further comprising applying a voltage to the collection belt and grounding the rotor.

23. The process of claim 21, wherein the collection belt is supported by an electrically conductive support structure, further comprising applying a voltage to the support structure and grounding the rotor.

24. The process of claim 21, further comprising applying a voltage to the rotor and grounding the collection belt.

25. The process of claim 21, wherein the rotor further comprises charging elements and a voltage is applied to the charging elements.

26. The process of claim 25, wherein the charging elements are pins directed radially towards the collection surface.

27. The process of claim 25, wherein the charging elements are pins directed tangentially towards the opening of the nozzle(s).

28. The process of claim 8, wherein the collection surface is located a distance of between about twice the thickness of the collected component(s) and about 15 cm from the nozzle.

29. The process of claim 28, wherein the collection surface is located a distance of between about 0.5 cm and about 8 cm from the nozzle.

30. The process of claim 1, wherein the fluidized mixture comprises polyolefin.

31. The process of claim 8, further comprising heating the collected material to a temperature sufficient to bond the material.

32. The process of claim 8, wherein the collected material comprises a polymeric fibrous material and further comprising passing hot gas through the collected material at a temperature sufficient to bond the material.

33. The process of claim 8, wherein auxiliary gas is supplied to a cavity between the rotor and the collection surface.

34. The process of claim 8, further comprising issuing a liquid mist from at least one fogging jet nozzle located along the periphery of the rotor.

35. The process of claim 1, wherein the fluidized mixture is a solution.

36. The process of claim 35, wherein the fluidized mixture is a solution comprising a polymer and a volatile spin agent and forms a plexifilamentary film-fibril material.

37. The process of claim 1, wherein the fluidized mixture is a solution comprising a polymer and a volatile spin agent and forms polymeric beads.

38. The process of claim 1, wherein the fluidized mixture is a mixture of pulp and fluid.

39. The process of claim 1, wherein the fluidized mixture is a mixture of particles and fluid.

40. The process of claim 1, further comprising flowing a gas through the rotor.

41. The process of claim 1, wherein the fluidized mixture is supplied to multiple nozzles, and wherein a portion of the nozzles spread the issued material at a first angle between about 20 and 40 degrees from the axial direction and a portion of the nozzles spread the issued material at a second angle opposite the first angle with respect to the axial direction.

* * * * *